US007316250B1

(12) United States Patent
Kent

(10) Patent No.: US 7,316,250 B1
(45) Date of Patent: Jan. 8, 2008

(54) MULTI-FUNCTIONAL WORKTABLE SYSTEM

(76) Inventor: Frank Michael John Kent, 12 Florian Road, London (GB)

( * ) Notice: Subject to any disclaimer, the term of this patent is extended or adjusted under 35 U.S.C. 154(b) by 0 days.

(21) Appl. No.: 10/130,662

(22) PCT Filed: Nov. 18, 2000

(86) PCT No.: PCT/EP00/11499

§ 371 (c)(1),
(2), (4) Date: Sep. 30, 2002

(87) PCT Pub. No.: WO01/36164

PCT Pub. Date: May 25, 2001

(51) Int. Cl.
*B25H 1/02* (2006.01)

(52) U.S. Cl. ..... 144/286.5; 144/287

(58) Field of Classification Search ..... 144/1.1, 144/286.1, 286.5, 287; 269/86, 90, 104, 269/139, 152, 154, 164, 28 R; 108/115, 108/121

See application file for complete search history.

(56) References Cited

U.S. PATENT DOCUMENTS 2,594,794 A * 4/1952 Mull ..... 269/219
4,199,135 A * 4/1980 Wohrle et al. ..... 269/100
4,350,066 A 9/1982 Volk
4,415,149 A * 11/1983 Rees ..... 269/88
4,487,403 A 12/1984 Burge
4,527,786 A * 7/1985 Hsu ..... 269/154
4,647,028 A * 3/1987 Yang ..... 269/139
5,052,454 A 10/1991 Meinhardt
5,383,977 A * 1/1995 Pearce ..... 144/1.1
5,681,034 A * 10/1997 Noniewicz ..... 269/139
6,039,095 A * 3/2000 Newman ..... 144/144.52
6,058,990 A * 5/2000 Kent ..... 144/286.5
6,299,152 B1 * 10/2001 Sangmeister et al. ..... 269/139

FOREIGN PATENT DOCUMENTS

GB 2287207 9/1995

* cited by examiner

*Primary Examiner*—Shelley M. Self
(74) *Attorney, Agent, or Firm*—Nixon Peabody, LLP; Corinne R. Gorski

(57) ABSTRACT

Described is a worktable system comprising a supporting structure (1) and fastening means (13) supported by said supporting structure (1) for fastening a workpiece, characterized in that said fastening means (13) are adapted to provide directional guidance for movement of a tool, in particular a power tool, to machine the workpiece while it is fastened by said fastening means (13).

25 Claims, 7 Drawing Sheets

MULTI-FUNCTIONAL WORKTABLE SYSTEM

BACKGROUND OF THE INVENTION

The present invention relates to a worktable system comprising a supporting structure and fastening means supported by the supporting structure for fastening a workpiece.

Such a worktable system has multi-functional use in connection with building work and the like. Usually, such a worktable system is transportable and, therefore, appropriate for home working.

Known worktable systems provide for unconvenient handling of workpieces in conjunction with power tools.

Therefore, an object of the present invention is to provide a worktable system which allows a convenient handling of workpieces in conjunction with power tools for machining workpieces.

SUMMARY OF THE INVENTION

In order to achieve the above and other objects, in accordance with the present invention, there is provided a worktable system comprising a supporting structure and fastening means supported by said supporting structure for fastening a workpiece, characterized in that said fastening means are adapted to provide directional guidance for movement of a tool, in particular a power tool, to machine the workpiece while it is fastened by said fastening means.

Accordingly, in the worktable system of the present invention the fastening means simultaneously fasten a workpiece and provide direction guidance for a tool to machine the workpiece. The workpiece can be machined at a point above and/or below the fastening means.

Every kind of tool and in particular every kind of power tool like e.g. a saw or a drilling machine can be used.

Further, it should be noted that in the terms of this invention, the "supporting structure" would normally comprise a top support with leg support structure, but it could also consist of a top frame only or have other constructions.

Preferably, stop means are provided for limiting the directional guidance.

Usually the fastening means comprise jaws. In such case, preferably at least one edge of at least one jaw can be adapted to provide for movement of the tool. So, an edge of a jaw length may be used as a guide for a tool to machine a workpiece. For instance, the workpiece may be clamped to and protrude from the underside of a jaw. The tool may be guided by the outside edge of a jaw or the inside edge of a jaw. Alternatively, the two inside edges of two jaws may be used when such jaws are set at a parallel width to suite the tool.

A guidance means for movement of the tool may be provided wherein the guidance means operatively cooperate with the fastening means.

In a further preferred embodiment wherein the fastening means comprise at least one groove, the guidance means may comprise at least one slider slidably received in the at least one groove. Alternatively, the guidance means may operatively cooperate with at least one edge of at least one jaw.

In case a tool support means for supporting the tool is provided, the fastening means may be adapted to provide guidance for movement of the tool support means, or the guidance means may be provided for movement of the tool support means.

In a still further preferred embodiment, the support means comprise a sliding mount for carrying the tool, the sliding mount being moveable at an angle, preferably at a right angle, with relation to the direction of the guidance provided by the fastening means. Stop means may be provided for limited the movement parth of the sliding mount. It is to be noted that the provision of such a sliding mount is considered an independent aspect of invention.

Preferably, the support means can comprise a plate for mounting a tool, said plate having at least one edge to operatively cooperate with at least one edge of at least one jaw. The plate may be adapted to be slidably held between two jaws. In this case the two inside edges of two jaws can be used as guidance when such jaws are set at a parallel width to suite the plate. Usually, the tool is mounted upon the plate.

In a still further preferred embodiment wherein the fastening means comprise jaws, the fastening means further comprise a moveable clamping element provided beneath the jaws and to be tightened up to the underside of at least one jaw for clamping the workpiece against the underside of the jaw. So, the jaw forms the fixed part of a vertical clamping system in which the moveable clamping element forms a second moveable part which is tightened up to the underside of the jaw.

Alignments means for aligning the workpiece in relation to the fastening means can be provided wherein the fastening means comprise jaws. In such embodiment, the alignment means may preferably be adapted so as to align the workpiece in line essentially perpendicular to the jaw length. So, for instance, a workpiece which may be clamped to the underside of a jaw may be aligned in a line perpendicular to the jaw length such that the tool using the edge of a jaw as a guide may machine the workpiece at a true right angle.

Moreover, support and alignment means may be provided between the jaws for supporting and aligning a workpiece at a point or points along the machining line of the tool. In this embodiment, the support and alignment means may preferably by adjustable from side to side and/or in vertical direction to suite the width of different tools and/or the depth of different thicknesses of workpieces.

Further, blade guiding means may be situated beneath the workpiece for guiding a blade of a jig saw to achieve a straight vertical cut.

Holding means may be attached to the fastening means for holding the workpiece at an adjustable height below, at the level of and/or above the fastening means. In case of the provision of jaws, the holding means may be attached to each of the jaws and hold a workpiece at an adjustable height below, between and above the surface of the jaws permitting as necessary the workpiece to slide between the holding means and/or to be held in a tightly clamped fixed position.

Of course, the fastening means may also be adapted so as to allow the workpiece to be moved in relation to the fastening means. In this embodiment, stops may further be provided for limiting the movement parth of the workpiece.

BRIEF DESCRIPTION OF THE DRAWINGS

The above and other objects and features of the present invention will become clear from the following description taken in conjunction with preferred embodiments with reference to the accompanying drawings in which.

DETAILED DESCRIPTION OF THE DRAWINGS

Figure 1:
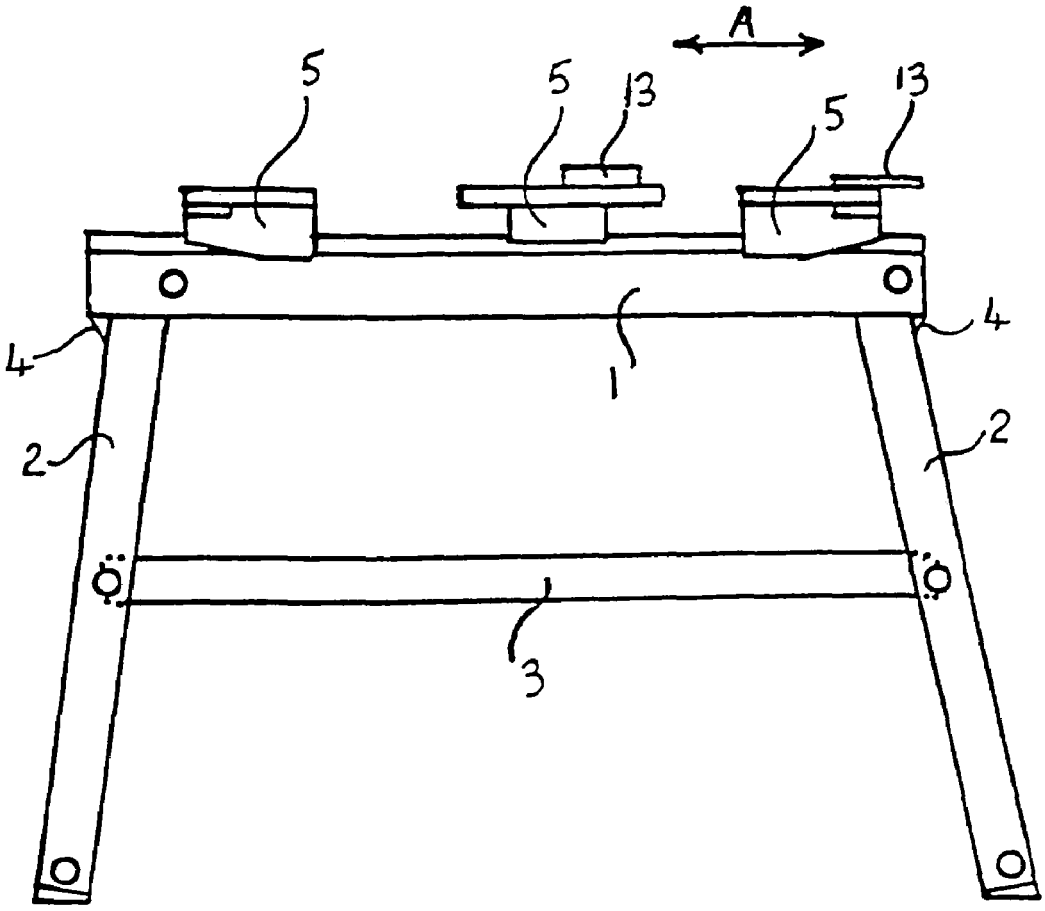
FIG. 1 is a schematic side view of a worktable.

In FIG. 1 it is shown a preferred embodiment of a worktable comprising a top frame 1 with inward folding leg supports 2 braced apart by removable struts 3 against blocking elements 4 and two or more work top sections 5 arranged in selected positions on the top frame 1, two of which are provided with jaws 13 defining a fastening means having clamping function for fastening a workpiece. The jaws 13 each form a rectangular plate essentially extending over the whole width of the top frame 1, wherein at least one of the jaws 13 is movable in a direction perpendicular to its length as indicated by arrow A in FIG. 1.

The worktable shown in FIG. 1 has a foldable construction for better stowing and transportation purposes. One suitable form of construction for the worktable is that it is employed in ladder fabrication so that hollow section top frame and leg support lengths joined by hollow section cross-members may provide lightness and rigidity.

Figure 2:
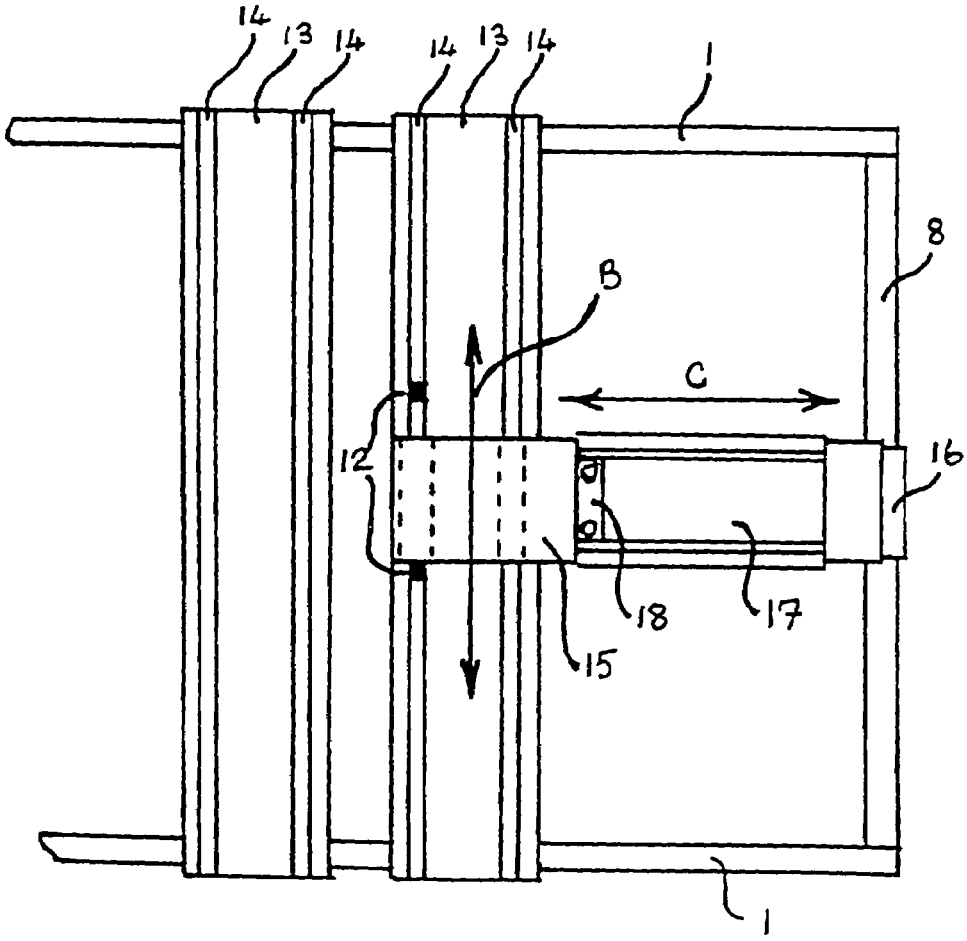
FIG. 2 is a partial schematic plan view of a first preferred embodiment of a worktop section of a worktable.
Figure 3:
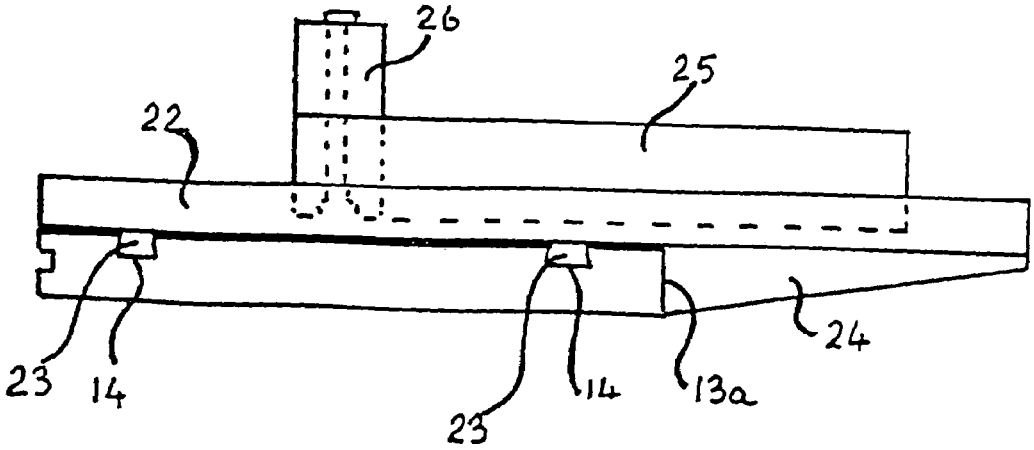
FIG. 3 is a partial schematic side view of a second preferred embodiment of a worktop section of a worktable.
Figure 4:
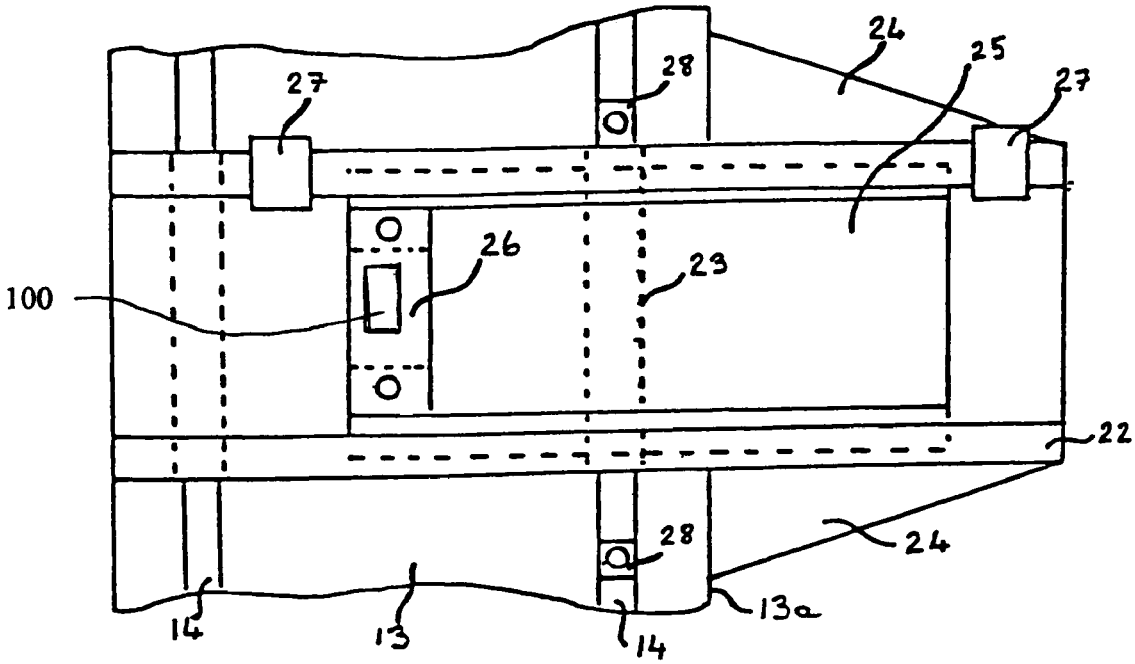
FIG. 4 is a partial schematic plan view of a second preferred embodiment of a worktop section of a worktable.
Figure 5:
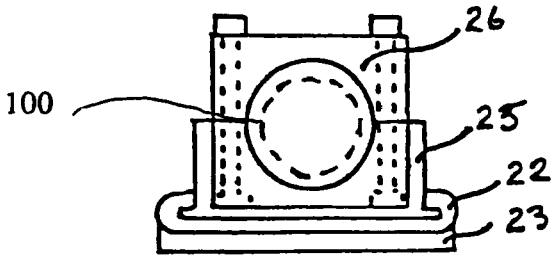
FIG. 5 is a schematic side view of the distal end of the sliding table and the sliding mount of the second embodiment.
Figure 6:
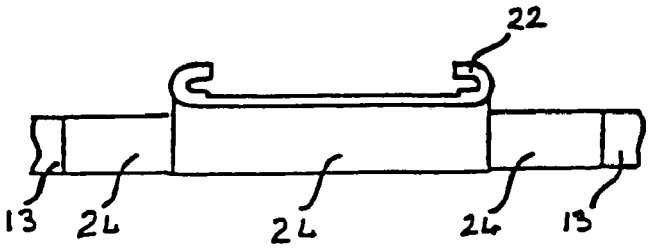
FIG. 6 is a schematic side view of the distal end of the sliding table showing its cross section shape in better detail of the second embodiment.

FIG. 2 is a schematic top view of a first preferred embodiment of the top frame 1 comprising a top frame cross-piece 8 forming one side and of the top frame 1. Shown in FIG. 2 are two jaws 13 which, as already mentioned above, each form a rectangular plate and are movable in a direction perpendicular to their length. Each jaw 13 includes a pair of grooves 14 spaced from each other and extending along the length of the jaws 13 adjacent to their edges, respectively. The grooves 14 are open to the top as seen in FIG. 2.

A sliding table 15 is in sliding engagement with the grooves 14 of one of the jaws 13 (i.e. the right-hand jaw 13 in FIG. 2) so as to slide in the line of arrow B in the direction of the length of the jaws 13 and, thus, of the width of the top frame 1. In order to limit the movement of the sliding table 15 along the grooves 14, there are provided stops 12 fitted in at least one of the grooves 14. Whereas the sliding table 15 is in sliding engagement with the grooves 14 and, thus, supported by the jaw 13 at its one end, the sliding table 15 is provided at its distal other end with a sliding mount 16 which supports the distal end of the sliding table 15 on the top frame cross-piece 8 in a sliding manner.

Further, the sliding table 15 comprises a sliding mount 17 which is movable perpendicular to the movement path of the sliding table 15 as indicated by arrow C. In order to limit the movement path of the sliding mount 17 along the sliding table 15, stops can be provided which are not shown in FIG. 2. Positioned on the sliding mount 17 is a mounting structure 18, e.g. a clamp, to hold a power tool, e.g. a drilling machine, (not shown) for machining a workpiece (not shown in FIG. 2) which is fastened by the jaws 13.

A preferred second embodiment of the top frame structure is shown in FIGS. 3 to 7.

Like in the first embodiment, the second embodiment also comprises a sliding table 22 which operates along the length of the jaw 13 by means of runners 23 which are mounted at the underside of the sliding table 22 and inserted into the grooves 14 of the jaw 13. At its distal end the sliding table 22 is provided with a rear guide 24 which forms a step and is in contact with one edge 13*a* (the right-hand edge according to the FIGS. 3 and 4) of the jaw 13 so as to run along such edge.

Like in the first embodiment, the second embodiment also comprises a sliding mount 25 which is movable in a direction perpendicular to the length of the jaw 13 and, thus, perpendicular to the movement path of the sliding table 22 so as to operate along the length of the sliding table 22.

Further, like in the first embodiment, a mounting structure 26 is arranged on the sliding mount 25 to fasten a power tool (not shown) for machining a workpiece (not shown). In the second embodiment, the mounting structure 26 is provided for holding a drilling machine and comprises two halves to be tightened together by screws and a circular opening defined by both halves to firmly clamp a portion of a drilling machine. Additional support means (not shown) could be provided for holding the power tool.

Figure 7:
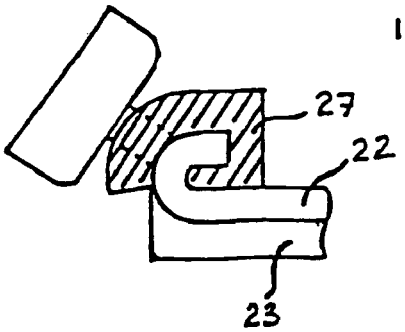
FIG. 7 a schematic enlarged view of a stop provided at a portion of the sliding table of the second embodiment.

Adjustable stops 27 are provided on the sliding table 22 to limit the movement of the sliding mount 25 along it. A detailed view of such a stop 27 is shown in FIG. 7.

Moreover, like in the first embodiment, stops 28 are also provided in at least one groove 14 of the jaw 13 to limit the movement of the sliding table 22 along the length of the jaw 13.

Figure 8:
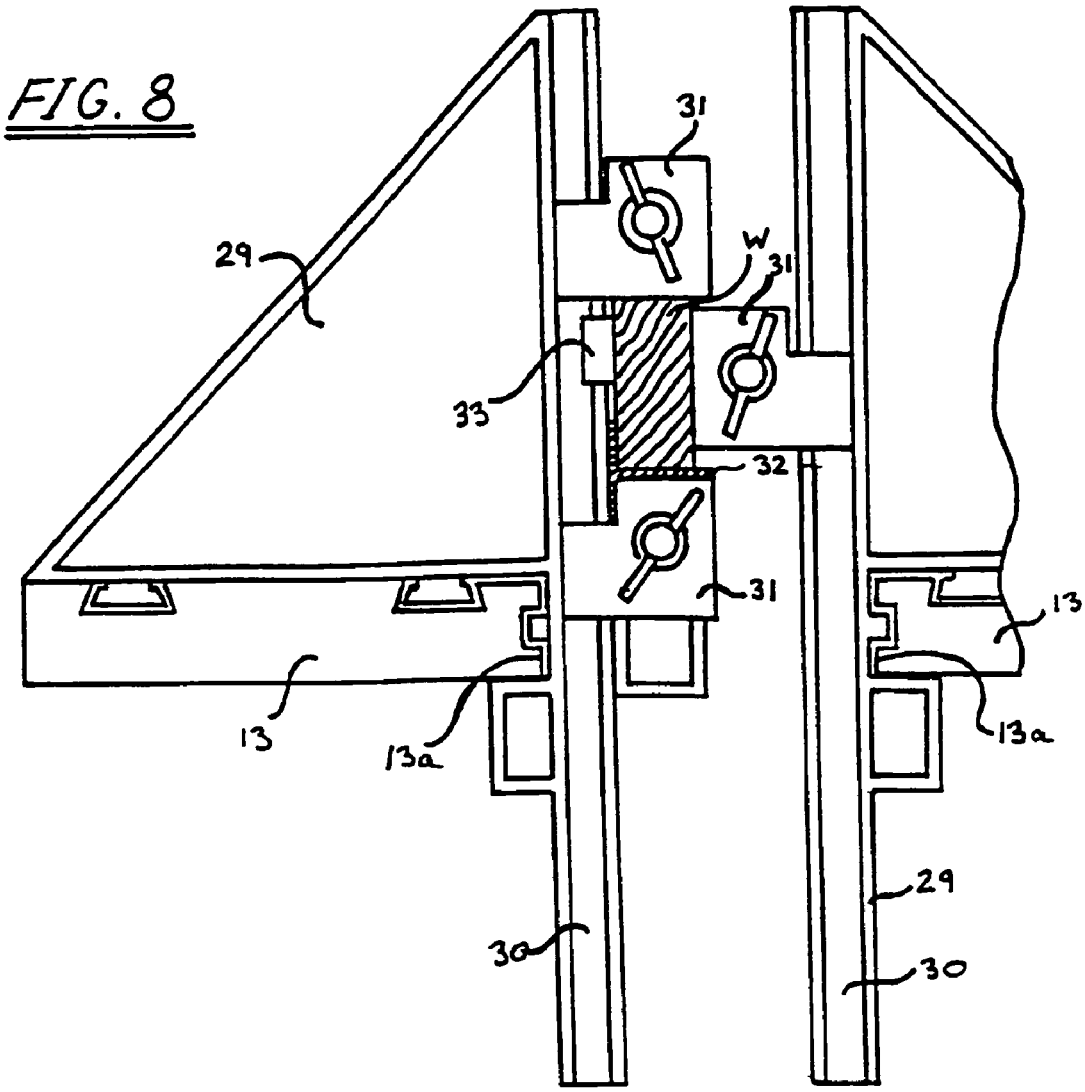
FIG. 8 is a partial schematic side view of a workpiece clamped at an adjustable level by means of workpiece supports.

FIG. 8 is a side view of a workpiece W clamped at an adjustable level by means of workpiece supports 29 which are attached to jaws 13. Each workpiece support 29 comprises a vertical track 30 and is mounted on the jaw 13 so that a portion of the rear side of the track 30 is in contact with the inner edge 13*a* of the jaw 13 facing the other jaw 13. The tracks 30 of the workpiece supports 29 are provided for attaching height adjusters 31 for determining the height of the workpiece W. The height adjusters 31 of at least two different workpiece supports 29 hold a T-shaped bar 32 wherein such height adjusters 31 must be inline. Along the T-shaped bar 32 the workpiece W may be slid or held firmly dependent upon the tightening of the jaws 13. The workpiece supports 29 further comprise a slide 33 which takes up the thickness of the T-shaped bar 32.

Figure 9:
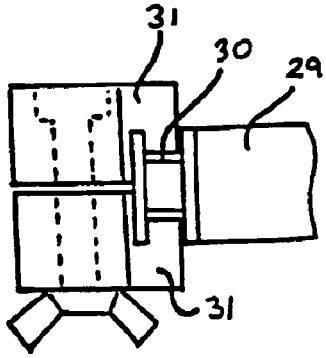
FIG. 9 is a partial schematic top view of a workpiece support.

FIG. 9 is a top view of a workpiece support 29 and the height adjuster 31 which is to be tightened into position by means of nut and bolt.

The workpiece supports 29 as shown in FIGS. 8 and 9 can be used in conjunction with the first embodiment of FIG. 2 as well as with the second embodiment of FIGS. 3 to 7, wherein the workpiece W is machined by a tool, in particular a power tool, supported on the top frame 1 as described above.

Figure 10:
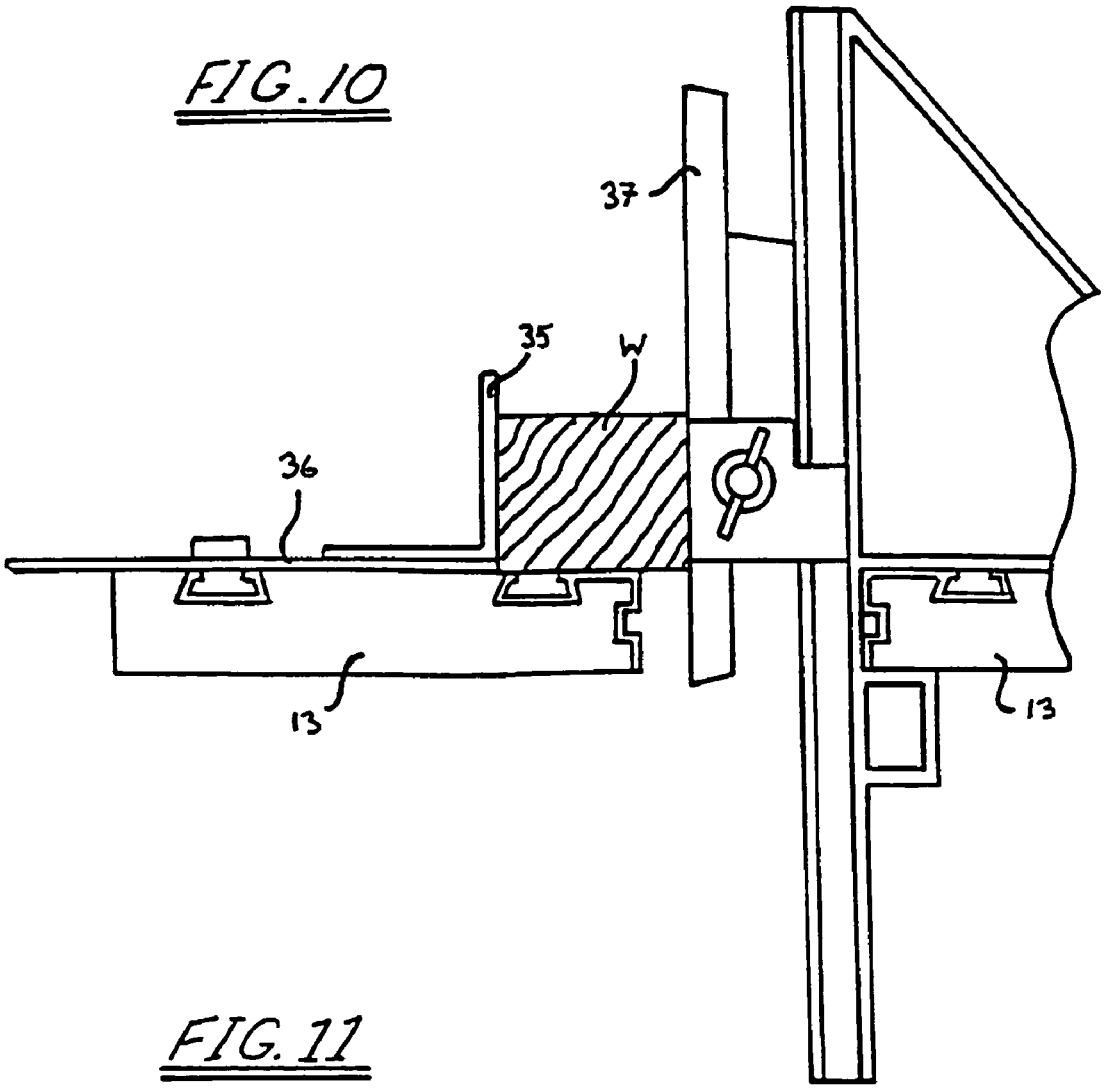
FIG. 10 is a schematic partical side view of another machining operation wherein the workpiece is fastened between an angle and a workpiece support.

FIG. 10 is a side view of another machining operation in which the workpiece W may slide along jaw 13 between an angle 35 mounted on the jaw 13 by means of a mounting base 36 which for instance is engaged with the groove 14 of the jaw 13 (as shown in FIG. 10). On the adjacent jaw 13 is fastened a workpiece support 29 as shown in the FIGS. 8 and 9. The situation shown in FIG. 10 is advantageous for using a sanding tool or a drilling machine having a sander instead of a drill bit. So, the height adjuster 31 of the workpiece support(s) 29 is provided such that the sander indicated by the reference numeral 37 in FIG. 10 touches the workpiece W. Slight tightening of the jaws 13 may gradually bring the workpiece W toward the sander 37.

The situation of FIG. 10 can be used with a first embodiment of FIG. 2 as well as with a second embodiment of FIGS. 3 to 7, too.

Figure 11:
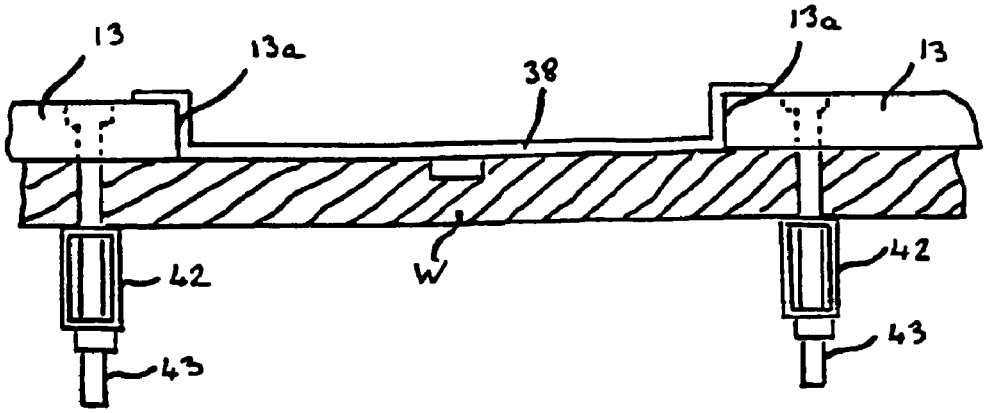
FIG. 11 is a schematic partial side view of another machining operation wherein the workpiece is clamped against the underside of the jaws.

FIG. 11 is a side view of a suspended system of clamping on the jaws 13 where bars 42 running along the length of the jaws 13 are suspended underneath the jaws 13 by means of long bolts 43 such that a workpiece W is clamped between the underside of the jaws 13 and the top side of the clamping bars 42. A plate 38 to which a router (not shown) may be attached is guided across the workpiece W to machine a cross channel. The plate 38 is held and guided between the inner edges 13*a* of the jaws 13 as shown in FIG. 11. A jig saw may be attached to the plate 38.

Figure 12:
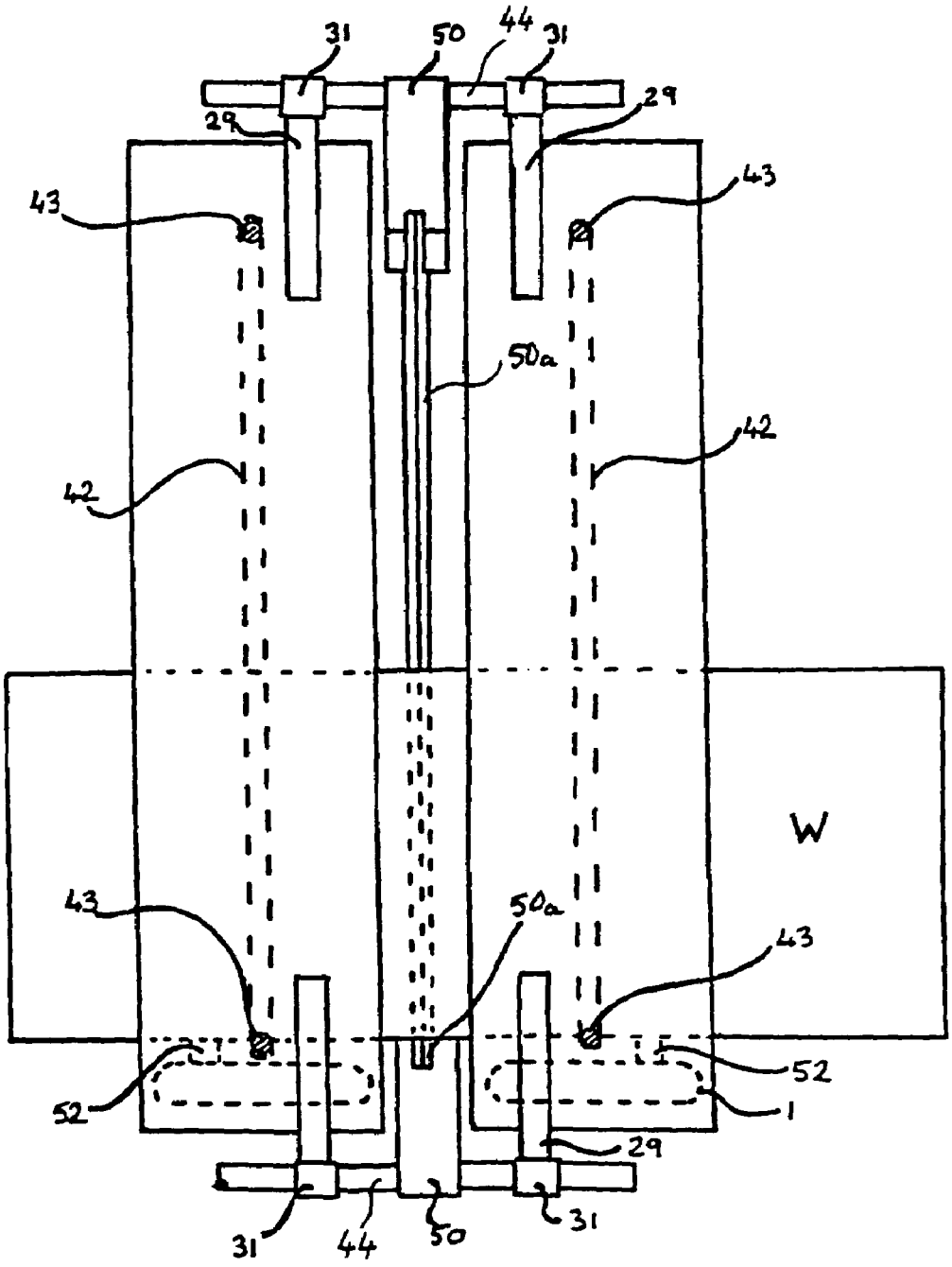
FIG. 12 is a schematic plan view of a further preferred embodiment of the worktop section of a worktable.

FIG. 12 shows a plan view of a further preferred embodiment of the worktop section of a worktable setup for jig saw cross-cut which table is provided with clamping bars 42 as already described above and shown in FIG. 11. So, in this embodiment, the workpiece W is clamped beneath the jaws 13 between the underside of the jaws 13 and the clamping bars 42. The jaws 13 are set at parallel spaced positions so as to suite a jig saw (not shown) therebetween which is guided along their inner edges 13*a*.

Further, a workpiece support 29 of the type as already shown in the FIGS. 8 and 9 is mounted at each face end of each jaw 13. So that four workpiece supports 29 are provided in the embodiment of FIG. 12. Whereas the workpiece supports 29 extend perpendicular to the length of the jaws 13 in the situations as shown in the FIGS. 8 and 10, the workpiece supports 29 extend in the direction of the length of the jaws 13 in the situation of FIG. 12.

Each pair of workpiece supports 29 positioned at the same face end of the jaws 13 is connected by a so-called saw end plate bar 44 which runs through a rectangular opening of a square 46 arranged at the underside of the height adjusters 31 (cf. FIG. 8). The saw end plate bar 44 also runs through a further rectangular opening formed in an end portion of a saw end plate 50.

Figure 13:
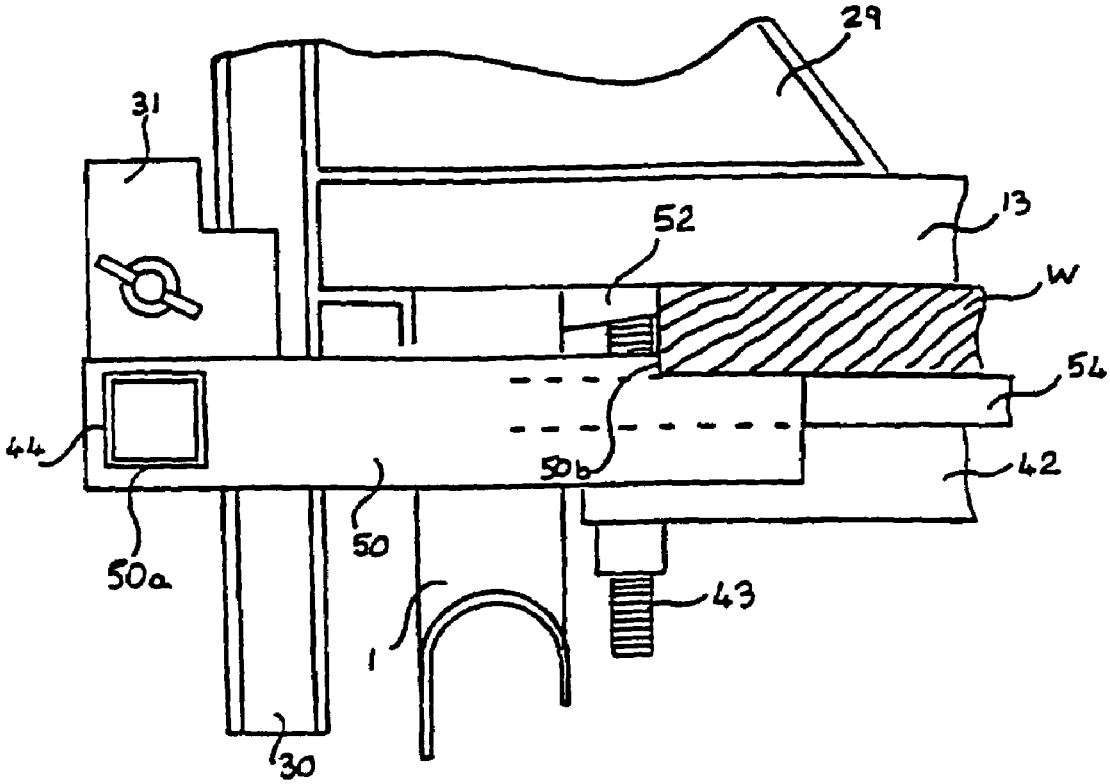
FIG. 13 is a schematic partial side view of the embodiment of FIG. 12.

The saw end plate 50 and the surrounding arrangement is depicted in better detail in FIG. 13 showing a side view of the embodiment of FIG. 12. As shown in FIG. 13, the cross section of the saw end plate bar 44 essentially corresponds to that of the opening 50*a* in the saw end plate 50; this applies to the opening of the square 46 of the height adjusters 31 (cf. FIG. 8), too.

At its inner end portion facing into the space between both jaws 13, both the saw end plates 50 each are provided with a vertical recess 50*a* which extends in the direction of the length of the space between the jaws 13 and, thus, in the direction of the movement of the blade of the jig saw (not shown) and is open to the space between the jaws 13. The recess 50*a* is shown in FIG. 12. Further, the saw end plate 50 comprises at its inner end portion a vertical step 50*b* which extends perpendicular to the length of the jaws 13 as shown in FIG. 13.

Beneath the jaws 13, alignment elements 52 are provided which are mounted to the top frame 1 (a part of the top frame is shown in dotted lines in FIG. 12 and in solid lines in FIG. 13). The alignment elements 52 and the vertical step 50*b* of the saw end plate 50 cooperate with each other so as to align the workpiece W in a line perpendicular to the length of the jaws 13 such that the jig saw (not shown) can machine the workpiece W at a true right angle up to its very end.

Figure 14:
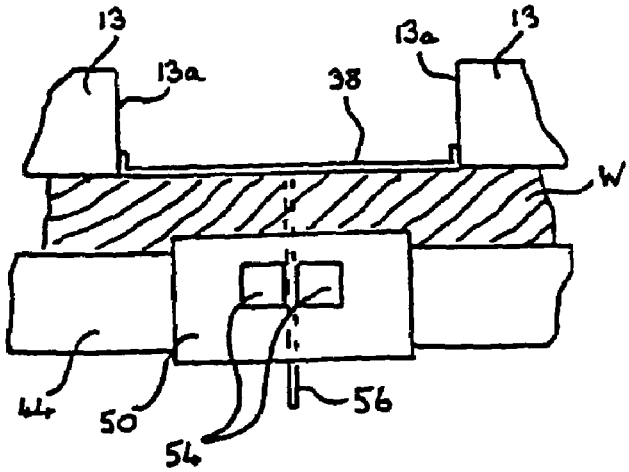
FIG. 14 is still another schematic partial side view of the embodiment of FIG. 12.

FIG. 14 regards the same situation as FIGS. 12 and 13 and shows an end view of the two jaws 13 whose inner edges 13*a* are provided for guiding the jig saw (not shown) therebetween. The view of FIG. 14 is similar to that of FIG. 11 in so far as the plate 38 is provided. Additionally, two plate guides 54 are positioned beneath the workpiece W (cf. also FIG. 13). The blade guides 54 each are provided as a rod and are spaced from each other so that therebetween a gap is defined for receiving and guiding the blade 56 of a jig saw (not shown) which is mounted on the plate 38.

The invention claimed is:

1. A worktable system for supporting a workpiece and a tool used to machine the workpiece, the system comprising:

a supporting frame;

clamping means for clamping the workpiece, said clamping means being disposed on said supporting frame, said clamping means including a pair of jaws movably disposed along said frame, and a clamping element movably located beneath the jaws, said clamping element attaching the workpiece to at least one of said jaws to hold the workpiece to said at least one jaw; and means for guiding the movement of the tool while the workpiece is held by said clamping element, said guiding mean being provided on at least one of said jaws, wherein said guiding means includes at least one groove disposed in one of said jaws and at least one slider slidably received in said at least one groove.

2. A worktable system according to claim 1, wherein said jaws each have opposed edges extending along a length of the jaw, and at least one edge of at least one jaw is adapted to provide said guiding means for guiding the movement of the tool.

3. A worktable system according to claim 1, wherein said guiding means operatively cooperate with said clamping means.

4. A worktable system according to claim 1, further comprising stop means disposed on at least one of said jaws for limiting the guidance provided by said guiding means.

5. A worktable system according to claim 1, further comprising tool support means movably disposed on at least one of said jaws for supporting the tool, wherein said clamping means guides the movement of said tool support means.

6. A worktable system according to claim 5, wherein said guiding means are provided for movement of said tool support means.

7. A worktable system according to claim 5, wherein said tool support means includes a sliding mount movably disposed on said tool support means for carrying the tool, said sliding mount being movable perpendicularly to the direction of the guidance provided by said clamping means.

8. A worktable system according to claim 7, further comprising stop means disposed on said sliding mount for limiting the movement of the sliding mount.

9. A worktable system according to claim 5, wherein said tool support means comprise a plate for mounting a tool, said plate having at least one edge which operatively cooperates with at least one edge of said at least one jaw.

10. A worktable system according to claim 9, wherein said plate is slidably disposed between said jaws.

11. A worktable system according to claim 2, further comprising alignment means attached to said support frame for aligning the workpiece in relation to said clamping means, wherein said alignment means align the workpiece perpendicular to the jaw length.

12. A worktable system for supporting a workpiece and a tool used to machine the workpiece, the system comprising:

a supporting frame;

clamping means for clamping the workpiece, said clamping means being disposed on said supporting frame, said clamping means including a pair of jaws movably disposed along said frame, and a clamping element movably located beneath the jaws, said clamping element attaching the workpiece to at least one of said jaws to hold the workpiece to said at least one jaw;

means for guiding the movement of the tool while the workpiece is held by said clamping element, wherein said jaws each have opposed edges extending along a length of the jaw, and at least one edge of at least one jaw is adapted to provide said guiding means for guiding the movement of the tool;

alignment means attached to said support frame for aligning the workpiece in relation to said clamping means, wherein said alignment means align the workpiece perpendicular to the jaw length; and support means movably disposed between the jaws for supporting and aligning the workpiece with the tool.

13. A worktable system according to claim 12, wherein said support means are adjustable from side to side and in a vertical direction with respect to the tool.

14. A worktable system according to claim 12, further comprising holding means attached to said clamping means for holding the workpiece at an adjustable height with respect to the tool.

15. A worktable system according to claim 14, wherein said clamping means allows the workpiece to be moved in relation to said clamping means.

16. A worktable system according to claim 15, wherein said supporting frame defines a planar support structure.

17. A worktable system according to claim 16, wherein at least a part of said clamping means operate in a horizontal and vertical plane.

18. A worktable system according to claim 17, wherein said means for guiding the movement of a tool is provided so as to machine the workpiece at a level above and below said supporting frame.

19. A worktable system according to claim 18, further comprising a sliding base movably mounted on at least one of said jaws for slidably engaging with the clamping means so as to achieve a directional movement with relation to the worktable system.

20. A worktable system according to claim 19, further comprising a sliding mount movably mounted on said sliding base for carrying the tool, said sliding mount being movable perpendicularly to the direction of the movement of the sliding base.

21. A worktable system according to claim 20, further comprising stop means disposed on said sliding base for limiting the movement path of the sliding mount.

22. A worktable system according to claim 12, wherein said support means are adjustable from side to side or in a vertical direction.

23. A worktable system according to claim 16, wherein at least a part of said clamping means operate in a horizontal or vertical plane.

24. A worktable system according to claim 17, wherein said means for guiding the movement of a tool is provided so as to machine the workpiece at a level above or below supporting frame.

25. A worktable system for supporting a workpiece and a tool used to machine the workpiece, the system comprising:

a supporting frame;

clamping means for clamping the workpiece, said clamping means being disposed on said supporting frame, said clamping means including a pair of jaws movably disposed along said frame, and a clamping element movably located beneath the jaws and spaced from an underside of the jaws, said clamping element being contiguous to the workpiece and attaching the workpiece to the underside of at least one of said jaws to hold the workpiece in the space between said clamping element and the underside of said at least one jaw; and means for guiding the movement of the tool while the workpiece is held by said clamping element, said guiding means being provided on at least one of said jaws.

* * * * *